US009791230B2

(12) United States Patent
Plourde et al.

(10) Patent No.: US 9,791,230 B2
(45) Date of Patent: Oct. 17, 2017

(54) MAGNETIC SHIELD FOR A SOLENOID OPERATED LOCKING DEVICE

(71) Applicant: Santa Cruz Gunlocks, LLC, Webster, NH (US)

(72) Inventors: John Plourde, Weare, NH (US); Tibor Kalman Zalavari, Budapest (HU)

(73) Assignee: Santa Cruz Gunlocks, LLC., Webster, NH (US)

( * ) Notice: Subject to any disclaimer, the term of this patent is extended or adjusted under 35 U.S.C. 154(b) by 0 days.

(21) Appl. No.: 15/271,390

(22) Filed: Sep. 21, 2016

(65) Prior Publication Data

US 2017/0082388 A1 Mar. 23, 2017

Related U.S. Application Data

(60) Provisional application No. 62/221,844, filed on Sep. 22, 2015.

(51) Int. Cl.
*F41A 17/06* (2006.01)

(52) U.S. Cl.
CPC ..... *F41A 17/06* (2013.01); *F41A 17/063* (2013.01)

(58) Field of Classification Search
CPC ..... F41A 17/06; F41A 17/063; A47B 81/00
USPC ..... 42/70.11
See application file for complete search history.

(56) References Cited

U.S. PATENT DOCUMENTS 4,354,189 A * 10/1982 Lemelson ..... E05B 49/006 340/10.33
5,303,495 A * 4/1994 Harthcock ..... F41A 9/62 42/1.02
6,282,829 B1 * 9/2001 Mossberg ..... F41A 17/063 42/70.04
6,601,332 B1 * 8/2003 Riebling ..... F41A 17/54 42/70.11
8,991,224 B2 * 3/2015 Zalavari ..... A47B 81/00 206/317
9,151,082 B2 * 10/2015 Zalavari ..... E05B 73/00
2002/0032976 A1 * 3/2002 Riener ..... F41A 17/063 42/70.11
2012/0291327 A1 * 11/2012 Boutot, Jr. ..... F41C 33/0263 42/70.11
2015/0033810 A1 * 2/2015 Zalavari ..... A47B 81/00 70/266
2015/0184428 A1 * 7/2015 Zalavari ..... E05B 73/00 70/13

(Continued)

*Primary Examiner* — Michael David

(57) ABSTRACT

A magnetic shield for a locking device such as a gunlock having a first portion and a second portion configured for controlled movement with respect to the other portion and for being held in a fixed and locked position vis-à-vis each other. At least one of the first and second portions includes an electromechanical locking mechanism including a solenoid and solenoid activated spring loaded pin configured, in a first position, for preventing the first and second portions from moving with respect one another and in a second position for allowing the first and second portions to move vis-à-vis one another. A magnetically conducive shield is disposed on or in at least one of the first and second portion that includes the solenoid locking mechanism, for preventing an unauthorized magnetic field from causing the solenoid to retract the spring loaded pin thereby allowing the locking device to be opened.

6 Claims, 6 Drawing Sheets

(56) References Cited

U.S. PATENT DOCUMENTS

| | | | | |
|---|---|---|---|---|
| 2015/0260480 | A1* | 9/2015 | Dunn | E05G 1/00 42/70.11 |
| 2016/0054080 | A1* | 2/2016 | Haimi | F41A 17/06 42/70.06 |
| 2016/0054083 | A1* | 2/2016 | Kiyani | F41A 17/063 42/70.11 |
| 2016/0327355 | A1* | 11/2016 | Zalavari | F41A 17/02 |

* cited by examiner (PRIOR ART)

(PRIOR ART)

(PRIOR ART)

MAGNETIC SHIELD FOR A SOLENOID OPERATED LOCKING DEVICE

CROSS-REFERENCE TO RELATED APPLICATIONS

This application claims priority from U.S. Provisional Patent Application No. 62/221,844 titled "Magnetic Shield For A Solenoid Operated Locking Device", which was filed on Sep. 22, 2015 and which is incorporated fully herein by reference.

TECHNICAL FIELD

The present invention relates to a solenoid operated locking device utilizing a solenoid driven locking pin such as a gun lock, and more particularly, relates to a shield of magnetically conductive material placed or arranged proximate a gunlock or other solenoid operated locking device, for preventing the unauthorized opening of the locking device using a magnet to activate the solenoid driven locking pin.

BACKGROUND INFORMATION

Certain enforcement, corrections, military, and civilian applications often require that firearms must be secured in a non-enclosed manner, ready to be rapidly unlocked, released from the locking mechanism and used.

There is an abundance of different types of firearms that one could potentially secure in a gunlock. All of these firearms differ in size, brand, structural and functional design, etc. In addition to the diversity of different firearms that must be compatible with these weapon gunlocks, creating a system for securing modern firearms is made harder by a flood of tactical accessories that are available. There are a wide variety of optics, lights, lasers, grips, stocks, and other tactical accessories that can be purchased and equipped on modern weapons. This abundance of different tactical accessories often makes securing the weapons outfitted difficult so that specialized gunlocks are required for each variation of weapon and/or accessories.

"Clamshell" style gunlocks are commonly used in various situations to secure these types of weapons. Examples of prior art clamshell locks include the Tufloc® brand small shotgun lock manufactured by Esmet Inc. of Canton Ohio and the SC-1 manufactured by Santa Cruz Gunlocks LLC of Webster, N.H., both of which are incorporated herein by reference. These clamshell gunlocks are typically made of aluminum or similar non-magnetically conductive material.

Tools, particularly expensive tools, are also often secured when not in use by some form of solenoid activated locking device.

Many if not most of such prior art clamshell gunlocks, as well as several other types of gunlocks and/or other solenoid activated locking devices, have an electronic unlocking mechanism which utilizes a solenoid to activate (i.e retract) a spring loaded pin placed in a portion of the gun lock. The pin is spring loaded and normally in the extended or locked position. When locked, the pin engages an opening in the gunlock or other locking device. Activating the solenoid causes the pin to be retracted, allowing the gunlock or other locking device to open. Unfortunately, the use of a solenoid activated lock has deficiencies as well. Specifically, when a magnet, such as a rare earth magnet or electromagnet for example, of a sufficient size/strength is placed proximate the gunlock in the area of the solenoid, the magnetic force from the magnet will activate the solenoid, retracting the pin and causing the gunlock to be able to be opened. This action allows for unauthorized access to the weapon thought to be safely locked and stored in the gunlock.

Accordingly, what is needed is a magnetic shield for all such prior art solenoid activated locking devices, which prevents or minimizes the ability for the lock device solenoid to be activated by an unauthorized individual utilizing a magnet or other solenoid activating device.

SUMMARY OF THE INVENTION

It is therefore a feature and object of the present invention to overcome various shortcomings and drawbacks associated with the prior art. An advantageous feature of the gunlock device of the present invention is to provide a locking device for securing an object such as a weapon or tool against theft while maintaining the flexibility to grant rapid, easy access.

The magnet shield device of the present invention facilitates securely holding a given firearm, tool or other object and also prevents unauthorized access to a firearm or tool, while still maintaining the firearm or tool in a rapidly accessible and deployable state.

An object of the magnetic shield for a solenoid activated locking device according to the present invention is to secure weapons, tools and other objects against theft despite inappropriate and unauthorized electromagnetic force applied to the lock utilizing a solenoid lock release by, for example, a magnet, by dispersing the magnetic field of the magnet before the magnetic field can activate the solenoid causing the locking pin that keeps the lock secured (locked) to be retracted. Such dispersion of any magnetic field being applied minimizes any opportunity for the solenoid activated lock pin to be retracted and minimizes the possibility of unauthorized opening of the lock. Additionally, the present invention gives users the ability to uniformly address a security deficit of a diverse range of different firearm gunlocks or other solenoid activated locking devices with a device that can be mechanically attached to their preferred gunlock or other locking device. Thus, the present invention facilitates enabling greater security of a wide variety of locks which lock and operate electromechanically by means of a solenoid activated locking pin or other mechanism.

The invention features, in one embodiment, a locking device for securing an object within the locking device. The locking device comprises a first portion and a second portion. At least one of the first portion and the second portion are configured, in one mode, for movement with respect to the other of the first and second portions and in another mode for being held in a fixed and locked position vis-à-vis each other.

At least one of the first portion and the second portions including an electro-mechanical locking mechanism that includes a solenoid and spring loaded pin. The spring loaded pin is operable between a first position and a second position. In a first position, the spring loaded pin is configured for preventing the first portion and the second portion from moving with respect to the other of the first portion and the second portion while in a second position, the spring loaded pin is configured for allowing the first portion and the second portion to move with respect to the other of the first portion and the second portion.

A magnetically conducive shield is disposed proximate the electro-mechanical device including the solenoid, and configured for shielding external magnetic fields from activating the solenoid and spring loaded pin to move into the second position.

The locking device may be a gunlock for securing a weapon and the magnetically conductive shield may be disposed along an external portion of at least one of the first portion and the second portion. The externally disposed magnetically conductive shield may be added to the locking device after construction and manufacturing of the locking device and/or added to the locking device during construction and manufacturing of the locking device.

The magnetically conductive shield may be disposed in an internal portion of at least one of the first portion and the second portion.

In another embodiment, the invention features a clamshell style gunlock having a magnetic shield. The clamshell style gunlock having a magnetic shield comprises a first portion and a body portion. The first portion may include a first hinge component while a body portion includes a second hinge component configured for cooperatively engaging with the first hinge component of the first portion, for allowing at least the first portion to move pivotably with respect to the body portion.

At least one of the first portion and the body portion includes a locking mechanism. The locking mechanism may include a spring loaded pin mechanism configured, in a first position, for preventing the first portion or the body portion from moving pivotably with respect to the other of the first portion and the body portion.

An electro-mechanical device is configured for operatively causing the spring loaded pin mechanism to move from the first position to a second position, wherein the second position allows one of the first portion or the body portion to move pivotably with respect to the other of the first portion and the body portion. A magnetically conducive shield is disposed proximate the electro-mechanical device, and is configured for shielding an externally provided magnetic field from acting on and activating the electro-mechanical device.

In one embodiment, the magnetically conductive shield may be disposed along an external portion of at least one of the first portion and the body portion and may be added to the gunlock after construction and manufacturing of the gunlock or in another embodiment, may be added to the gunlock during construction and manufacturing of the gunlock.

The gunlock may further include a solenoid disposed in the body portion, and a locking pin, coupled to the solenoid. The locking pin is configured in a first extended position for aligning with a counterpart recess within the first portion when the first portion is in a closed position abutting the body portion. The solenoid is configured to operate in an energized state and a non-energized state, and wherein in an energized state, the solenoid is configured to retract the locking pin out of the recess within the first portion.

In another embodiment, the magnetically conductive shield is disposed in an internal portion of at least one of the first portion and the body portion.

BRIEF DESCRIPTION OF THE DRAWINGS

These and other features and advantages of the present invention will be better understood by reading the following detailed description, taken together with the drawings of one embodiment of the invention wherein.

DETAILED DESCRIPTION OF THE PREFERRED EMBODIMENTS

The following detailed description is provided relative to an exemplary embodiment of the present invention having a magnetic gunlock shield which seeks to overcome various disadvantages in the prior art. Although the present invention will be explained in the context of a clamshell gunlock, the exemplary embodiment is not exclusive nor exhaustive of all possible embodiments and uses for the present invention. Specifically, the magnetic lock shield of the present invention provides a satisfactory solution for clamshell gunlocks for those persons who wish to secure their firearm in the above described 'ready' state without sacrificing a quality of safety against unauthorized electromagnetic opening as well as other gunlocks and other solenoid operated locking devices.

Figure 5:
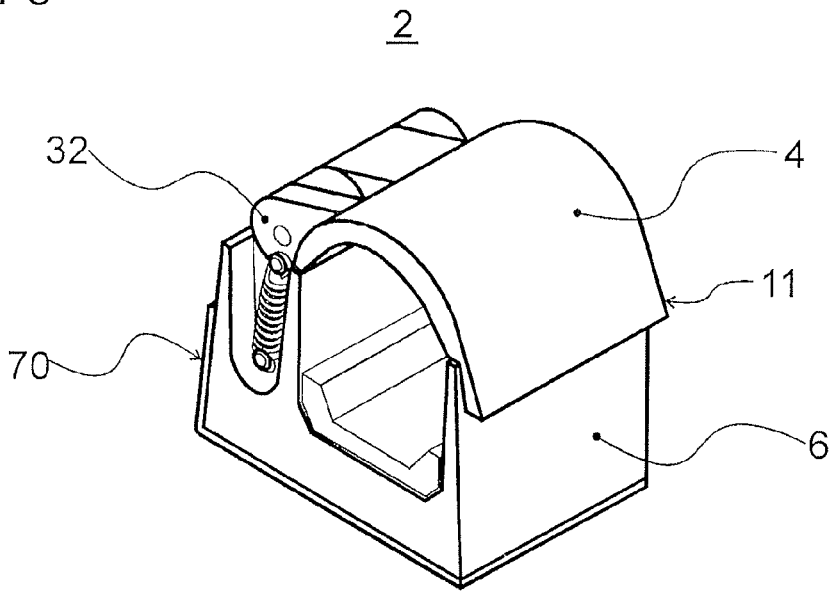
FIG. 5 is an end perspective view of a clamshell gunlock with an add-on magnetic shield according to a first embodiment of the present invention.
Figure 6:
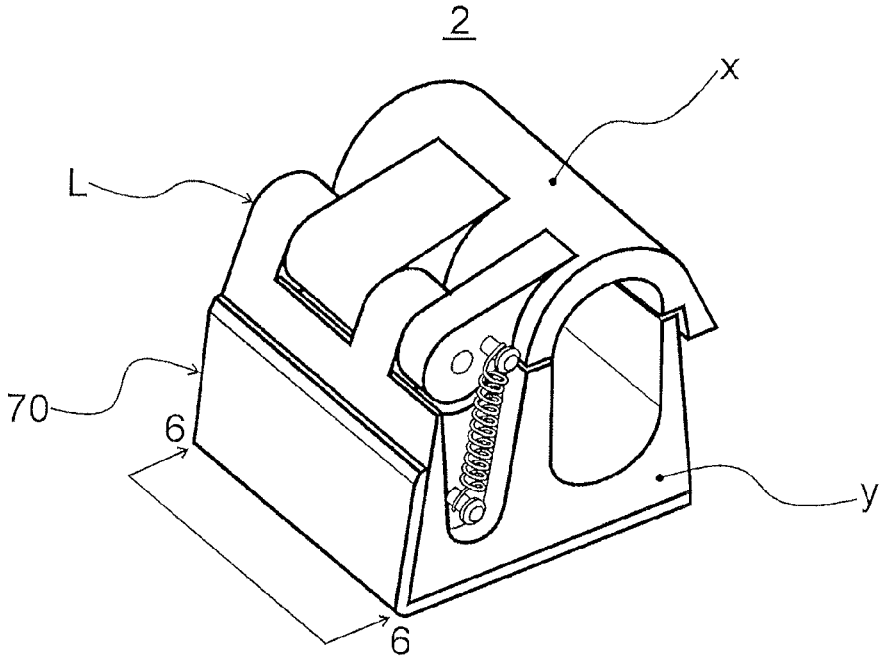
FIG. 6 is a back side perspective view of the clamshell gunlock of FIG. 5 utilizing the add-on magnetic shield extending along an exterior length of a rear and bottom portion of the gunlock according to another embodiment of the invention.
Figure 7:
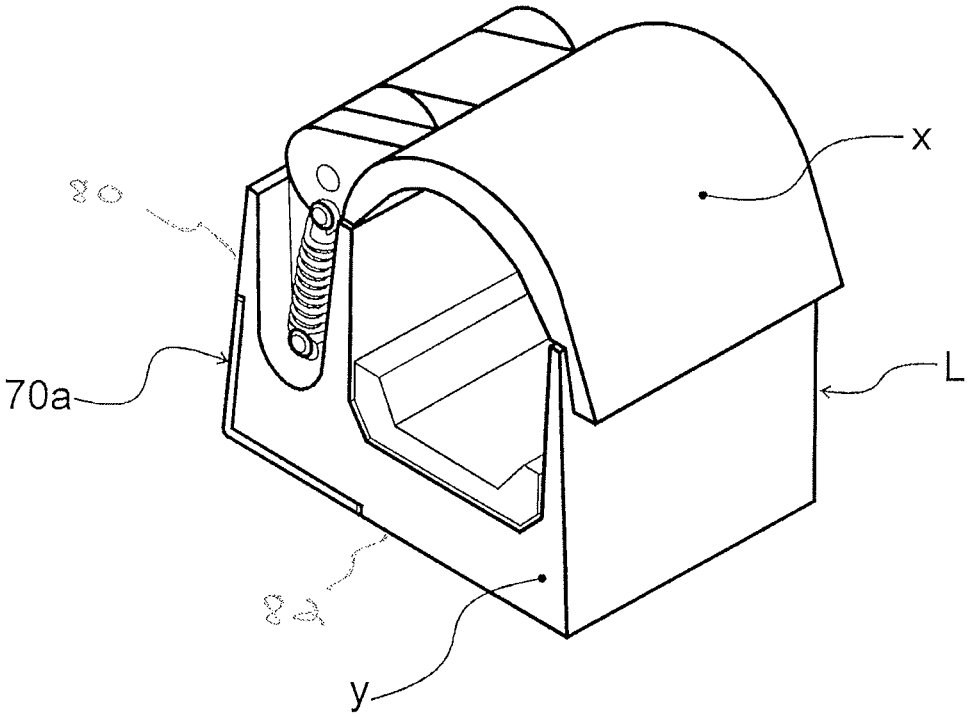
FIG. 7 is a perspective view of a clamshell gunlock utilizing the magnetic shield of the invention in a gunlock recess sized and located to accommodate the magnetic shield.

Three exemplary embodiments of the invention are described herein with reference to FIGS. 5-8 in which in a first embodiment shown in FIGS. 5 and 6, the magnetic shield 70 is added-on to an existing clam shell lock exterior region at least along the bottom and/or side portions; while in another embodiment shown in FIG. 7, the shield 70*a* is embedded or "built-in" within at least a portion of the sidewall 80 and/or the bottom portion 82 of the clamshell gunlock and thus, may not be externally visible.

These embodiments are illustrated and incorporated in connection with, for exemplary purposes only, a clamshell style gunlock device 2 having a hingeable top portion 4 and a bottom portion/casting 6 which are maintained in a closed position vis-à-vis one another when in a locked position. In the exemplary embodiment, the top portion 4 and body portion 6 interlock in an overlapping fashion along the front edge 11 of the gunlock 2 which provides a strong mechanical connection between the two components of the gunlock.

The basic components, construction and operation of the exemplary clamshell style gunlock are well known in the industry and are incorporated herein by reference.

Figure 1:
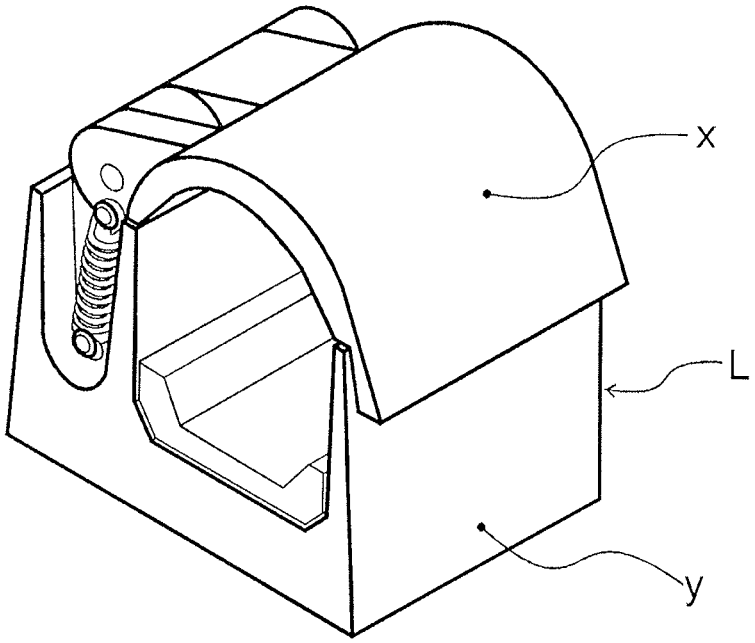
FIG. 1 is a perspective view of a prior art clamshell gunlock in a closed position.
Figure 2:
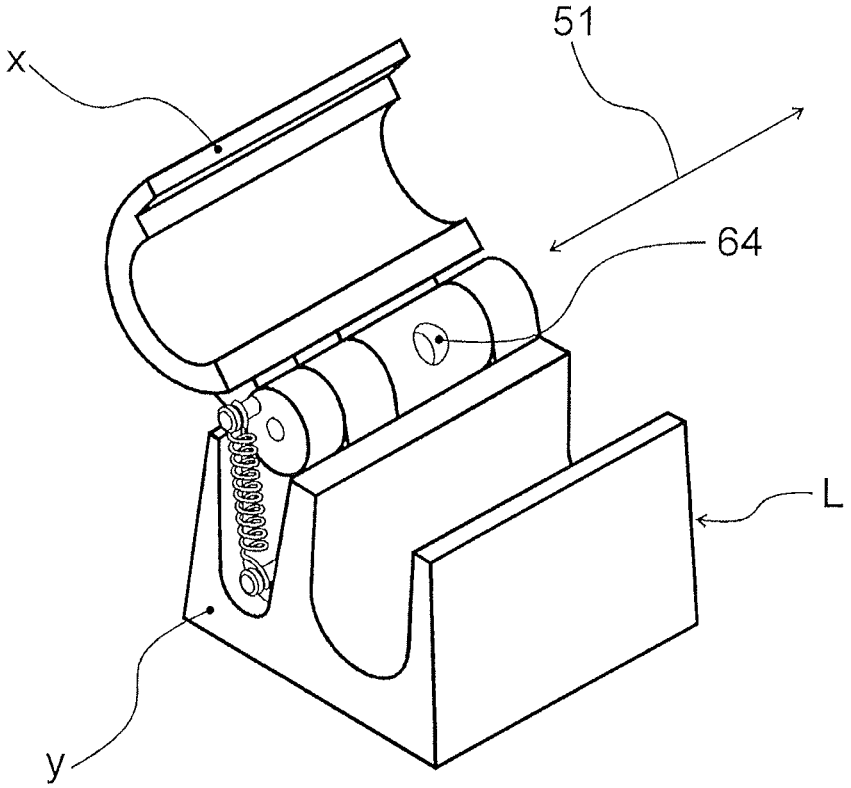
FIG. 2 is a perspective view illustrating a prior art clamshell gunlock in an open position.

The top portion 4 and bottom portion 6 engage at two points: along hinge 32 and along a front edge 11. The top portion 4 rotates about the hinge 32 such that the gunlock device 2 opens and closes in a clamshell fashion. When open, as illustrated, for example in FIGS. 2 and 4, the top portion 4 pivots or rotates about axis 51. When closed, as illustrated, for example in FIGS. 1, 3, 5, 6, 7 and 8, the top portion 4 and body portion 6 engage at two points, providing a strong mechanical connection between the two components 4, 6 of the gunlock device 2. That is, in this embodiment illustrating a clamshell style gunlock, the solid physical connection along the front edge 11 and the pivot or hinge 32 between the body portion 6 and top portion 4 are sufficiently strong enough to ensure that the gunlock can retain the firearm securely.

Figure 3:
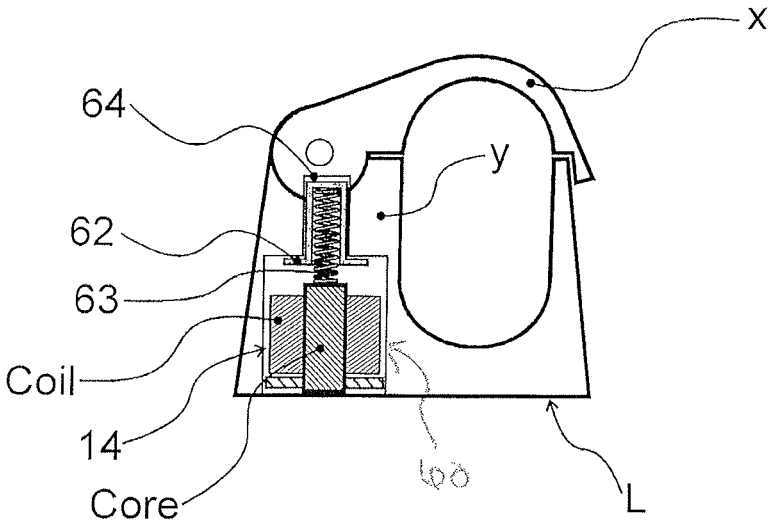
FIG. 3 is a cross-sectional view of the prior art clamshell gunlock of FIG. 1 illustrating the solenoid and locking pin in the extended and locked position.
Figure 4:
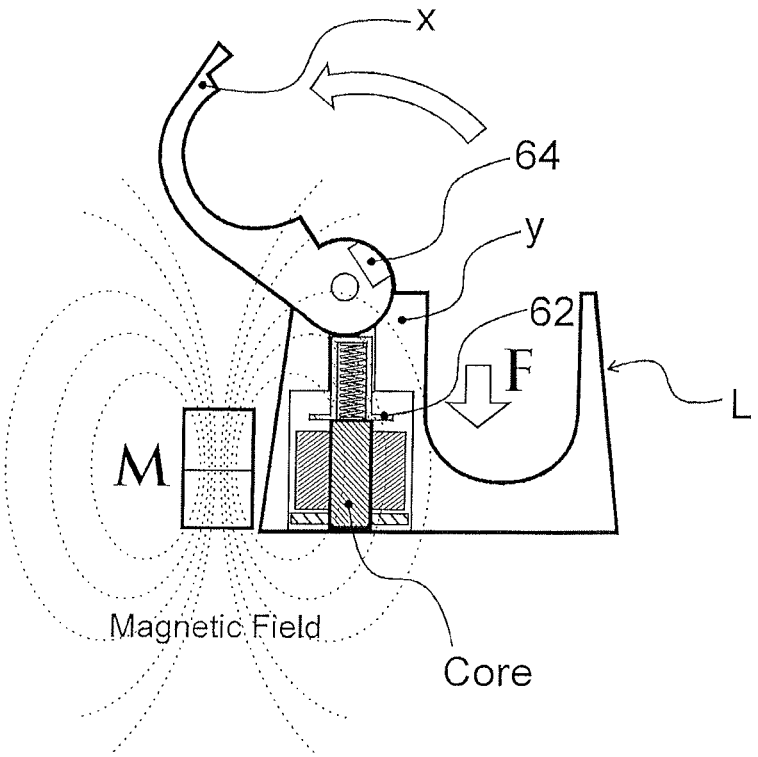
(PRIOR ART) FIG. 4
FIG. 4 is a cross-sectional view of the prior art clamshell gunlock of FIG. 1 illustrating the solenoid and locking pin in a retracted and unlocked position caused by an external magnetic field from, for example, a magnet.
Figure 8B:
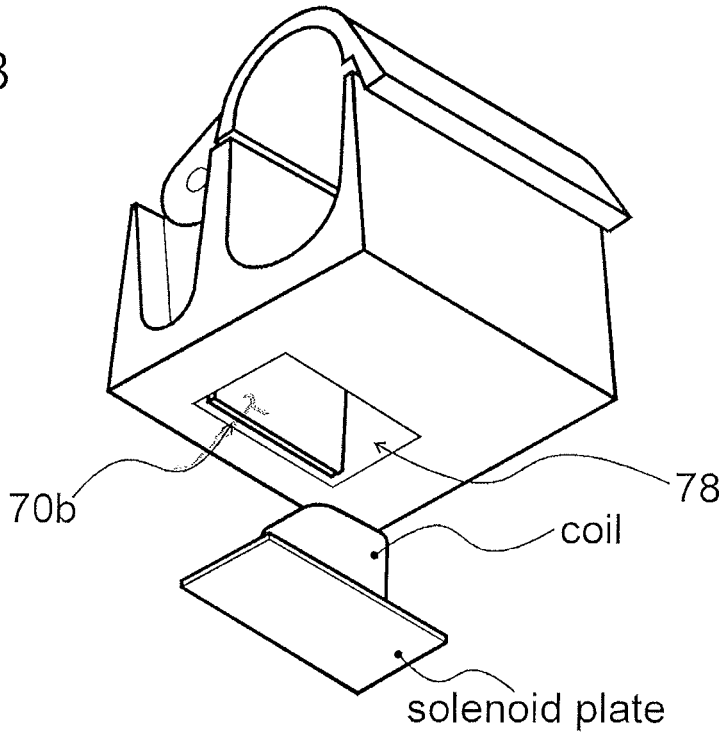
FIG. 8B is a bottom exploded bottom view of the gunlock of FIG. 8A illustrating the installation and location of an inner magnetically conductive shield plate serving as a magnetic shield in accordance with the teachings of the present invention.
Figure 8A:
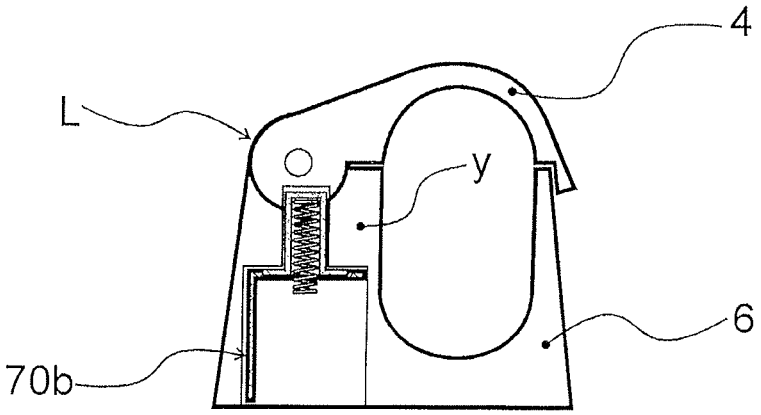
FIG. 8A is a cross-sectional view similar to the view of FIG. 3 illustrating an internal magnetically conductive shield plate shielding the solenoid coil from magnetic fields.

The clamshell gunlock 2 is held in a closed position by the clamshell gunlock's electro-mechanical locking mechanism 14 including an electronically operated solenoid 60, FIG. 6, which includes a spring 63 loaded magnetically conductive latch or pin 62, disposed in a normally extended position (as shown in FIG. 3), that engages with an opening 64 in the top portion 4 (see FIGS. 3 and 8A)

Before operation, the gunlock 2 is securely mounted to an appropriate surface to prevent unauthorized removal of the firearm (not shown) to be secured in the gunlock 2 through and by means of the body portion 6. Such a surface might be any structurally secure surface where the firearm, tool or other object is to be secured, such as a police vehicle partition wall, trunk, dash of a vehicle, and the like. A number of mounting points (not shown) in the body portion 6 and appropriate mounting hardware (also not shown) mount the body portion 6

In an exemplary embodiment, the clamshell gunlock's electro-mechanical locking mechanism 14 will automatically engage after a solid and precise connection has been made by the top portion 4 with the body portion 6. In this embodiment, during operation the top portion 4 pivots at the hinge 32 towards the body portion 6. The protrusion along the lip 11 of the top portion 4 engages a corresponding channel of the body portion 6 when the gunlock is in operation in a closed position. The spring loaded pin or latch 62 pushes upwardly into the opening 64 in the top portion 4, securing the gunlock in a locked position.

In this embodiment, operating the locking mechanism 14 by electrically energizing the solenoid 60 to retract the solenoid locking pin 62 from engagement with the opening 64 in the top portion 4 quickly releases the connection between the body portion 6 and top portion 4 so that the top portion 4 may be pivoted upwardly apart from the body portion 6 (see FIGS. 2 and 4 for example) when access to the firearm locked in the gunlock 2 is desired. The locking mechanism 14 may be activated via a mechanical key override or electronically via a switch which energizes the solenoid 60.

An electro-mechanical lock system 14 is used in multiple gunlock and/or other locking systems as it enables the use of various recognition systems for the activation, opening and control of the device by an authorized person. Examples of such systems which could be used include, but are not limited to: concealed pushbutton switches, time delays, computer operated solutions, biometric scanning technologies, RFID readers, facial or voice recognition systems, and various other solutions for controlling electro mechanic devices.

As previously mentioned, an unexpected and unintended security weakness of these electro-mechanical lock systems was recently discovered. Specifically, if a strong enough magnet (a magnet, such as a rare earth magnet, or any other similarly designed magnetic field generator, such as a sufficiently strong electro-magnet, is passed underneath or adjacent that portion of a gunlock 2 utilizing an electro-mechanical lock system 14, the material of the gunlock (typically aluminum or an iron ore composite) does not prevent transmission of the magnetic force of the magnet or other magnetic field generator to the solenoid (see FIG. 4). Instead, the magnetic force generated by the magnetic field acts directly upon the solenoid 60, causing the solenoid to energize and retract the locking pin 62 from an engaging orifice 64 in an opposite component of the gunlock. Thus, the application of an external magnetic force proximate the solenoid activated gunlock enables unauthorized access to the 'securely' held firearm in the gunlock 2. A magnet's strength is typically measured as its Gauss strength and thus based upon what magnet strength is needed to "activate" the solenoid would define the amount of magnetic field the present invention is shielding against.

Therefore, a feature of the present invention provides advantages over the prior art solenoid operated gunlocks or other solenoid operated locking devices of any type or shape in the form of a shield against unwanted electromagnetic tampering. That is, by providing a magnetically conductive shield 70, FIGS. 5-8, such that the shield envelopes or shields all or a sufficient portion of the electro-mechanical locking mechanism 14 of the gunlock or other solenoid operated locking device, the shield 70 dissipates any magnetic forces generated by a magnet or other magnetic field generator and thus prevents any unauthorized electromagnetic activation of the solenoid and electro-mechanical locking mechanism 14.

FIGS. 5 and 6 are perspective front and rear right side views illustrating an embodiment of a shield of the invention externally "retrofitted" to an existing gunlock by attaching the magnetic shield 70 along an exterior rear/bottom portion of a clamshell gunlock. The shield preferably extends along a rear and bottom region of the body portion 6 so as to substantially "shield" at least a bottom and/or rear portion of the internal solenoid 14 from external unauthorized magnetic interference. In this embodiment, the shield 70 may extend along only a portion of a length of the gunlock along the rear and/or bottom edge of the rear portion of the gunlock although this is not a limitation of the invention. The shield 70 should be sized (length, width and thickness) and arranged so as to sufficiently shield the internal solenoid from the effects of an external magnetic field causing it to activate in an unauthorized manner. The shield may be attached in any manner known in the art including utilizing screws, nuts and bolts, glue, welding or any other attachment means and her mechanism.

Moreover, an additional advantage of the present embodiment is the ability to incorporate this shield with multiple types of gunlocks and provide a mechanical fix to an inherent electromagnetic weakness. By providing an L-shaped or other shaped metal plate having a width of between approximately 3" to 3.5", a length of between approximately 3" to 5", and a thickness of between approximately 0.1" to 0.2", this embodiment of the invention is of sufficient size to provide a magnetic shield for many different models of gunlocks against a wide variety of magnets and electro-magnets. Those skilled in the art will know and understand that the length, width and thickness of the magnetic shield will be determined by the type of gunlock and the position or location of the solenoid within the gunlock.

The shield can be produced from any magnetically conductive material that is capable of sufficiently dispersing any magnetic forces from the magnetic field of the magnet or other magnetic field producing device away from the solenoid. Materials such as ceramic, aluminum, or glass are not sufficiently conductive and thus are insufficient to prevent any magnetic force from activating the solenoid.

In accordance with a second embodiment of the magnetic shield for a gunlock or other locking device according to the invention, a shield 70*a*, FIG. 7 may be "embedded" into an exterior portion of the gunlock 2. As shown, the shield 70*a* is embedded in the bottom and side regions of the body 6 so as to substantially enclose at least a portion of the bottom and rear portions of the internal solenoid from external unauthorized magnetic forces which would serve to activate the solenoid. In this embodiment, the shield 70*a* extends along a length of the gunlock along the rear bottom edge of the rear portion of the gunlock a sufficient amount so as to shield the solenoid from external magnetic fields although the shield 70*a* may only have to extend along one or the other of the side or bottom region of the body portion 6.

Another embodiment of the magnetic shield of the invention is shown in FIGS. 8A and 8B and illustrates an embodiment wherein the magnetic shield 70*b* is located internally to the gunlock and is designed and shaped to fit within the cavity 78 housing the solenoid 60 and to sufficiently shield the solenoid from unauthorized external magnetic fields.

Accordingly, the present invention provides a magnetic shield for a solenoid activated locking device, such as a gunlock, that serves to disburse or dissipate any external magnetic fields or magnetic forces presented by a magnetic force generating device away from the solenoid to prevent unintended and unintentional activation of the solenoid by unauthorized individuals and wherein such action might allow the gunlock to be opened and unauthorized access to the gun, tool or other object stored therein.

Although the present invention has been explained with regards to a clamshell gunlock, this is not a limitation of the present invention as the magnetic shield of the invention may be utilized in and with any type of gunlock or other locking device which utilizes an appropriately energized electromechanical device such as a solenoid to provide access to the locking device or gunlock without departing from the spirit and scope of the present invention.

Modifications and substitutions by one of ordinary skill in the art are considered to be within the scope of the present invention, which is not to be limited except by the allowed claims and their legal equivalents.

What is claimed is:

1. A clamshell style gunlock having a magnetic shield comprising:

a first portion, said first portion including a first hinge component;

a body portion including a second hinge component configured for cooperatively engaging with the first hinge component of said first portion, for allowing at least said first portion to move pivotably with respect to said body portion;

at least one of said first portion and said body portion including a locking mechanism, said at least one of said first portion and said body portion including said locking mechanism constructed of a non-magnetically conductive material, said locking mechanism including a spring loaded pin mechanism configured, in a first position, for preventing said first portion or said body portion from moving pivotably with respect to the other of said first portion and said body portion;

an electro-mechanical device disposed in said at least one of said first portion and said body portion including said locking mechanism, said electro-mechanical device coupled to said locking mechanism and responsive to at least one of electrical activation and activation from a magnetic field of sufficient magnitude to activate said electro-mechanical device, said activated electro-mechanical device configured for operatively causing said spring loaded pin mechanism of said locking mechanism to move from said first position to a second position, wherein said second position allows one of said first portion or said body portion to move pivotably with respect to the other of said first portion and said body portion; and a magnetically conductive shield, disposed proximate said electro-mechanical device, and configured for shielding an externally provided magnetic field from acting on and activating said electro-mechanical device and operatively causing said spring loaded pin mechanism of said locking mechanism to move from said first position to a second position, by sufficiently disbursing any magnetic forces from the magnetic field of the magnet or other magnetic field producing device away from the electro-mechanical device.

2. The gunlock of claim 1, wherein said magnetically conductive shield is disposed along an external portion of at least one of the first portion and the body portion.

3. The gunlock of claim 2, wherein said externally disposed magnetically conductive shield is added to said gunlock after construction and manufacturing of said gunlock.

4. The gunlock of claim 2, wherein said externally disposed magnetically conductive shield is added to said gunlock during construction and manufacturing of said gunlock.

5. The gunlock of claim 1 wherein the electro-mechanical device further comprises a solenoid disposed in said body portion, and a locking pin, coupled to said solenoid, said locking pin configured in a first extended position for aligning with a counterpart recess within the first portion when the first portion is in a closed position abutting said body portion; and wherein said solenoid is configured to operate in an energized state and a non-energized state, and wherein in an energized state, the solenoid is configured to retract the locking pin out of the recess within the first portion.

6. The gunlock of claim 1, wherein said magnetically conductive shield is disposed in an internal portion of at least one of the first portion and the body portion.

* * * * *